US007128625B2

(12) United States Patent
Saito

(10) Patent No.: US 7,128,625 B2
(45) Date of Patent: Oct. 31, 2006

(54) TILT AND TRIM SYSTEM OF OUTBOARD DRIVE OF PROPULSION UNIT

(75) Inventor: Hideaki Saito, Kahegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 93 days.

(21) Appl. No.: 10/711,337

(22) Filed: Sep. 12, 2004

(65) Prior Publication Data

US 2005/0090163 A1 Apr. 28, 2005

(30) Foreign Application Priority Data

Oct. 22, 2003 (JP) ..... 2003-362542

(51) Int. Cl.
*B63H 5/125* (2006.01)

(52) U.S. Cl. ..... 440/61 T

(58) Field of Classification Search ..... 440/53, 440/61 R, 61 T; 91/422; 92/85 R, 143, 92/181 P
See application file for complete search history.

(56) References Cited

U.S. PATENT DOCUMENTS 6,165,032 A * 12/2000 Nakamura ..... 440/61 R
6,176,170 B1 * 1/2001 Uppgard et al. ..... 91/422
6,287,160 B1 * 9/2001 Onoue ..... 440/61 R

FOREIGN PATENT DOCUMENTS

JP 07-69289 3/1995

* cited by examiner

*Primary Examiner*—Lars A. Olson
(74) *Attorney, Agent, or Firm*—Ernest A Beutler

(57) ABSTRACT

A tilt and trim system for the outboard drive of a marine propulsion unit wherein the popping up action is effectively damped without positive stops that could cause abrupt stopping and possible damage.

6 Claims, 9 Drawing Sheets

TILT AND TRIM SYSTEM OF OUTBOARD DRIVE OF PROPULSION UNIT

BACKGROUND OF INVENTION

This invention relates to a tilt and trim unit for an outboard drive propulsion system and more particularly to an improved hydraulic arrangement for such applications wherein popping up is permitted when underwater articles are struck but the entire range of such movement is limited in a way wherein shocks at the end of travel are reduced.

Hydraulically operated units of this type are well known and frequently employ a hydraulic system for effecting not only trim adjustment during running operation, but also rapid tilt up to an out of the water position for trailering or servicing. As noted above these units frequently incorporate, generally in their trim portion, a shock absorbing arrangement that permits the propulsion unit to pop up when an underwater obstacle is struck and return to their trim adjusted position after the obstacle is cleared. The shock absorbing function is also calibrated to resist popping up when operating in reverse.

A typical type of such devices is shown in Japanese Published Application, number JP 07-69289, published Mar. 14, 1995. However if the underwater article is struck with sufficient force, the stroke of the shock absorbing piston can easily be insufficient and the resulting direct contact of the elements can cause damage. Stiffening of the shock absorbing action is not really an acceptable solution.

It is therefore a principal object of this invention to provide an improved hydraulic arrangement for such applications wherein popping up is permitted when underwater articles are struck but the entire range of such movement is limited in a way wherein shocks at the end of travel are reduced.

SUMMARY OF INVENTION

This invention is adapted to be embodied in a tilt and trim arrangement for an outboard drive that is supported for pivotal movement about an axis on a watercraft hull. The tilt and trim arrangement is comprised of a first unit fixed for pivotal movement relative to the hull and a second unit adapted to be connected to the outboard drive. One of the units comprises a body defining a cylinder bore. The other of the units comprises a piston reciprocating in the cylinder bore and dividing the cylinder bore into two axially spaced chambers. A piston rod is fixed to the piston and extends through one of the chambers for connection to the respective of the outboard drive and the hull. Shock absorbing valves control the flow between the cylinder chambers upon movement of the piston relative to the cylinder bore. In accordance with the invention a spring biased piston is contained in one of the chambers for further damping the movement of the piston in the one chamber.

DETAILED DESCRIPTION

Figure 1:
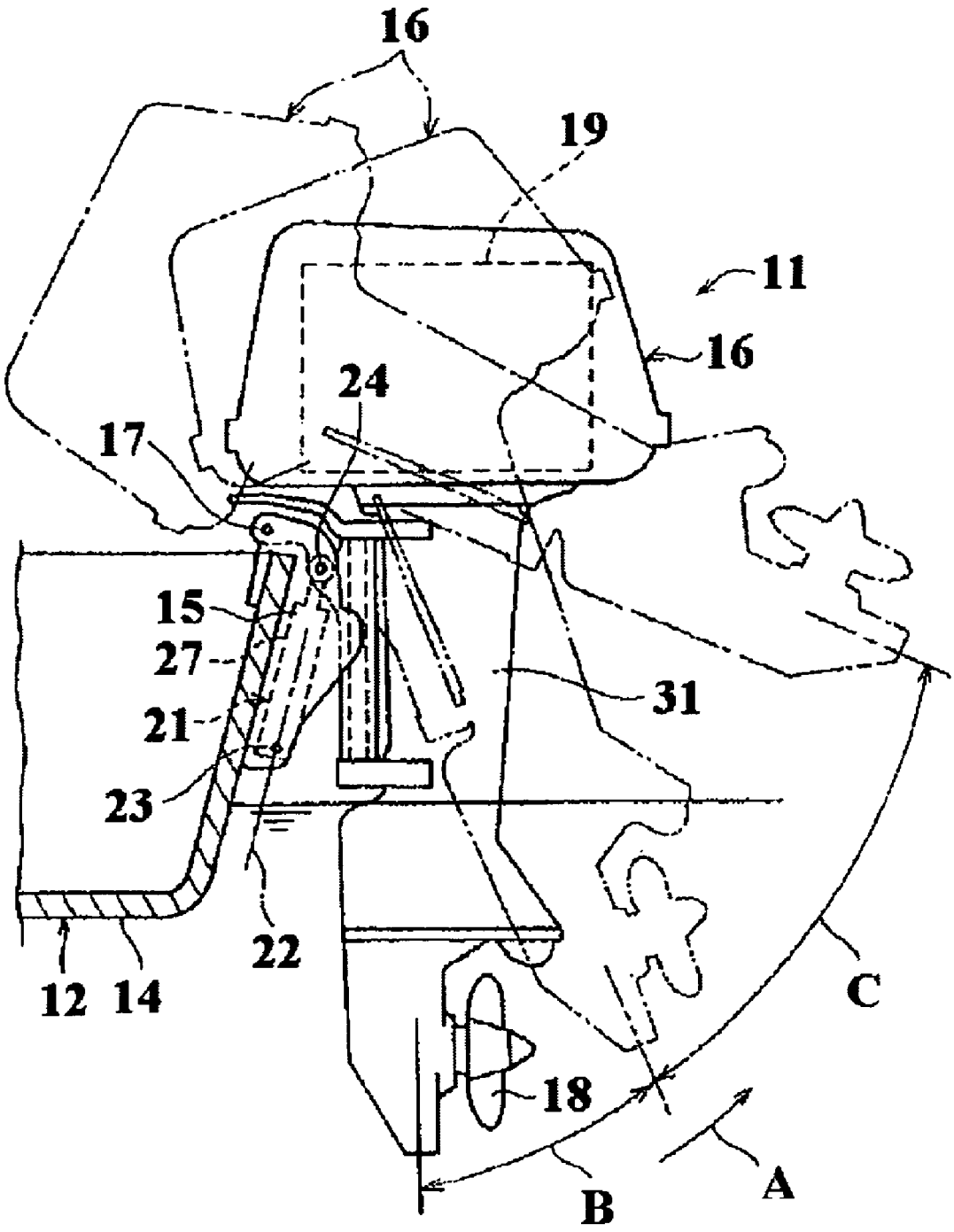
FIG. 1 is a side elevational view of a portion of a watercraft (shown partially and in cross section) with a propulsion unit attached utilizing a tilt and trim unit constructed in accordance with the invention, showing the range of trim and tilt movements in phantom lines.

Referring now in detail to the drawings and initially to FIG. 1, a watercraft propulsion unit in the form of an outboard motor 11 for propelling a watercraft such as a boat, indicated generally at 12 is supported on a transom 13 formed at a rear of a hull 14 of the boat 12. The outboard motor 11 includes, as part of its tilt and trim apparatus, a clamp bracket 15 removably mounted to the rear of the transom 13 of the hull 14 by means of fasteners (not shown).

As is well known in the art, the outboard motor 11 includes a propulsion unit, indicated generally at 16 provided at a rear of the clamp bracket 15 and pivotally supported by an upper part of the clamp bracket 15 by means of a pivot pin 17 to allow a propulsion device such as a propeller 18 at the lower part of the propulsion unit 16 to pivot in a manner to be described. The propeller 18 is driven in any desired manner such as by an internal combustion engine, indicated schematically at 19.

The upward pivotal movement from the fully tilted and trimmed down position shown in solid lines in FIG. 1 is rearward and upward in the direction of the arrow A in this figure through a trim range B and a fully tilted up range C. This movement is effected and controlled by a hydraulic tilt and trim cylinder constructed in accordance with the invention and indicated generally by the reference numeral 21. The tilt and trim cylinder is mounted with its axis 22, to be described in more detail later by reference to the remaining figures, extending in a generally vertical direction with its lower end pivotally supported by a lower part of the clamp bracket 15 by means of a lower pivot 23, as is well known in the art and in a specific manner to be described in more detail later. A piston rod (to be identified in more detail later) of the tilt and trim cylinder assembly 21 has its upper end pivotally connected to the propulsion unit 16 by means of an upper pivot 24, in a manner as will also be described in more detail later. As will be described later, a pressurized oil control system controls delivery to/or exhaust from the chambers, to be described, of the tilt and trim cylinder 21 to operate the tilt and trim cylinder 21.

Figure 2:
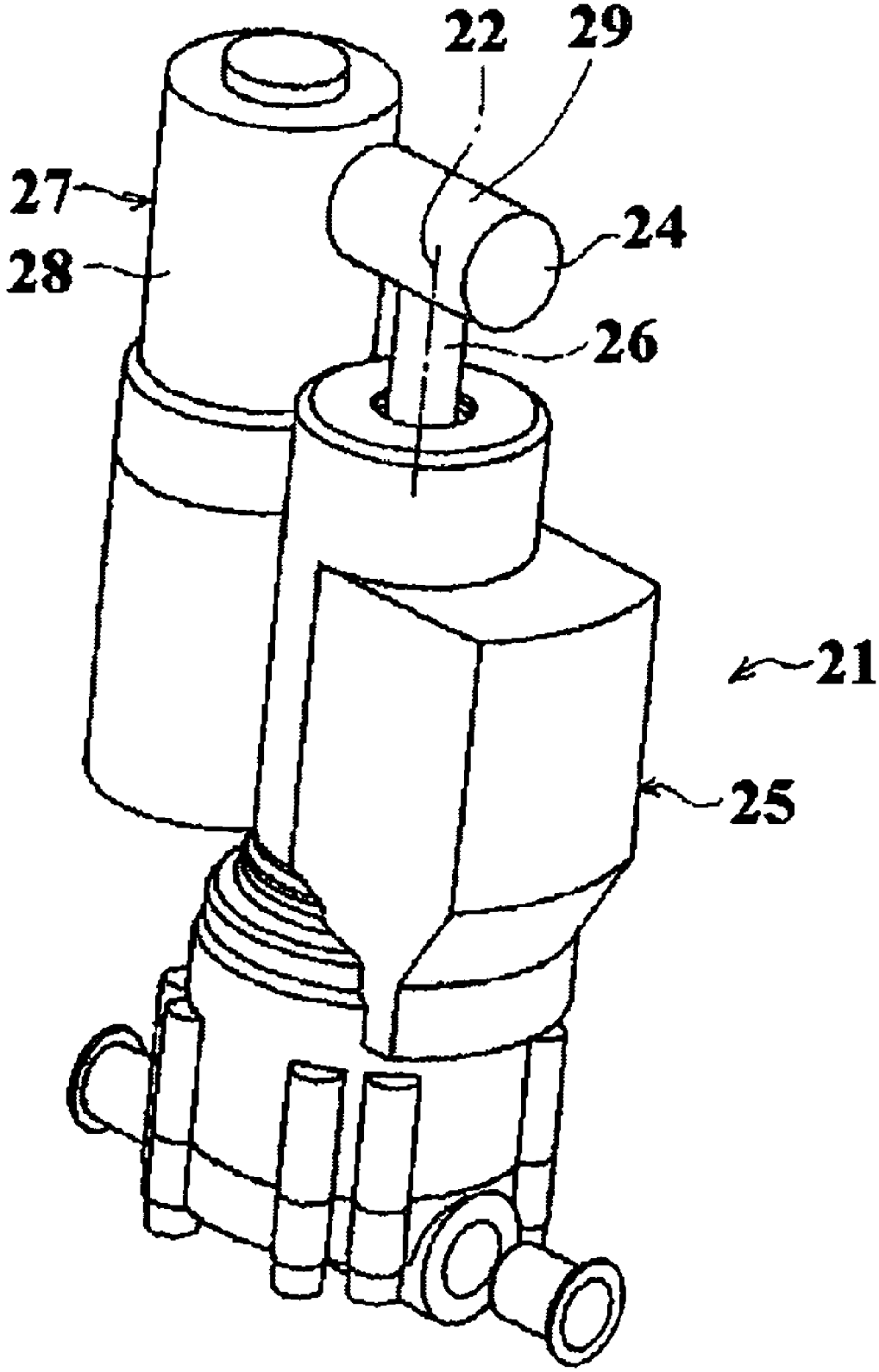
FIG. 2 is a perspective view of the trim and tilt unit.

Referring now to FIG. 2, this shows in perspective, the tilt and trim cylinder 21 that includes a cylinder body, indicated generally by the reference numeral 25, and from which the aforenoted piston rod 26 extends in a generally upward direction. Mounted to one side of the cylinder body 25 are some components of a hydraulic control system, indicated generally at 27. This system 27 includes a housing 28 that contains a reversible electric motor.

As seen in this figure the upper pivot 24 is pivotally carried in a trunion 29 formed on the upper end of the piston rod 26. This upper pivot 24 has its opposite ends journalled in a manner to be described in a drive shaft housing 31 of the outboard motor 11 (see FIG. 1).

Figure 3:
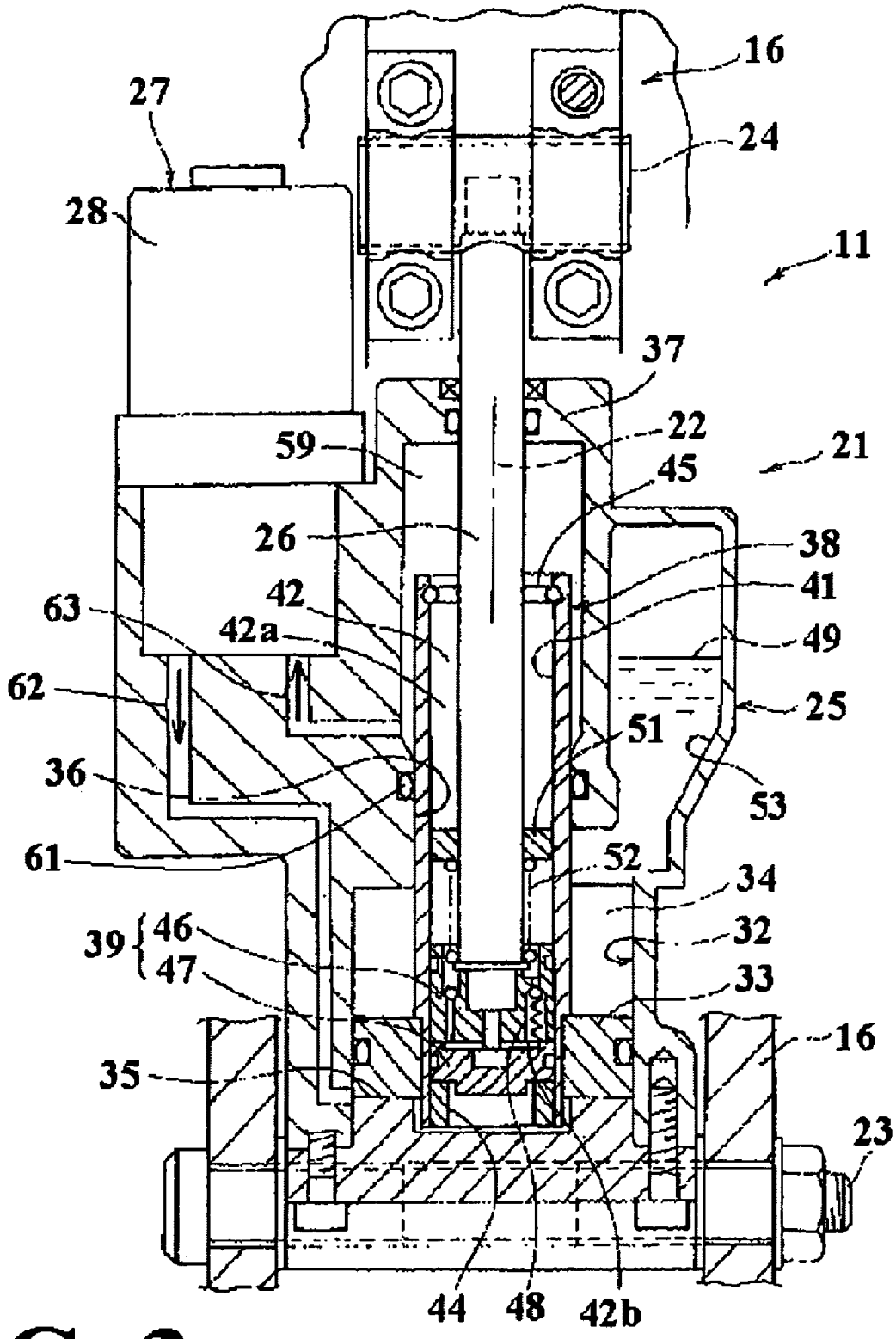
FIG. 3 is a cross sectional view of the tilt and trim unit taken through a transverse axis of the cylinder, showing the fully trimmed and tilted down position.

Referring now to FIG. 3 and as has already been noted, the tilt and trim cylinder 21 includes a cylinder body 25 that forms its outer shell and which is pivotally supported by the lower part of the clamp bracket 15 by means of the lower pivot 23. The cylinder body 25 has a larger diameter cylinder bore 32 formed around the axis 22, into which a large diameter piston 33 is fitted for reciprocation in the axial direction. The piston 33 divides the large cylinder bore 32 into an upper chamber 34 and a lower chamber 35.

A smaller diameter cylinder bore 36 is formed around the axis 22 in a part of the cylinder body 25 above the large cylinder bore 32 with its upper end closed by an integral end wall 37 of cylinder body 25 with its lower end communicating with an upper end of the large cylinder bore 32. A cylinder tube 38 is reciprocally fitted into the small cylinder bore 36 for movement in the axial direction and is fixed to the large piston 33. A small piston, indicated generally at 39, is supported for reciprocation in a smaller cylinder bore 41 formed in the cylinder tube 38. The small piston 39 divides the smaller cylinder bore 41 into upper and lower bore portions 42 and 43, respectively.

The piston rod 26 is fixed to and extends upward from the small piston 39 through the end wall 37 along the axis 22. The upper, exposed end of the piston rod 26, as has been noted, provides the pivotal connection to the propulsion unit 16 through the upper pivot 24.

A stopper ring 44 is fixed in the smaller cylinder bore 41 of the cylinder tube 38 to limit the downward movement of the small piston 39 In a like manner, an upper stopper ring 45 is provided to prevent the small piston 39 from moving up further than an upper predetermined position in the smaller cylinder bore 41.

The small piston 39 is comprised of upper and lower piston portions 46 and 47 that are each individually reciprocal in the smaller cylinder bore 41. The upper piston portion 46 divides the upper bore portion 42 of the smaller cylinder bore 41 into upper and lower areas 42*a* and 42*b*, respectively. The piston rod 26 extends upward from the upper piston portion 46 through both the lower bore area 42*b* and the upper bore area 42*a*. The stopper ring 45 prevents the upper piston portion 46 of the small piston 39 from moving up further than the predetermined position in the smaller cylinder bore 41.

Figure 4:
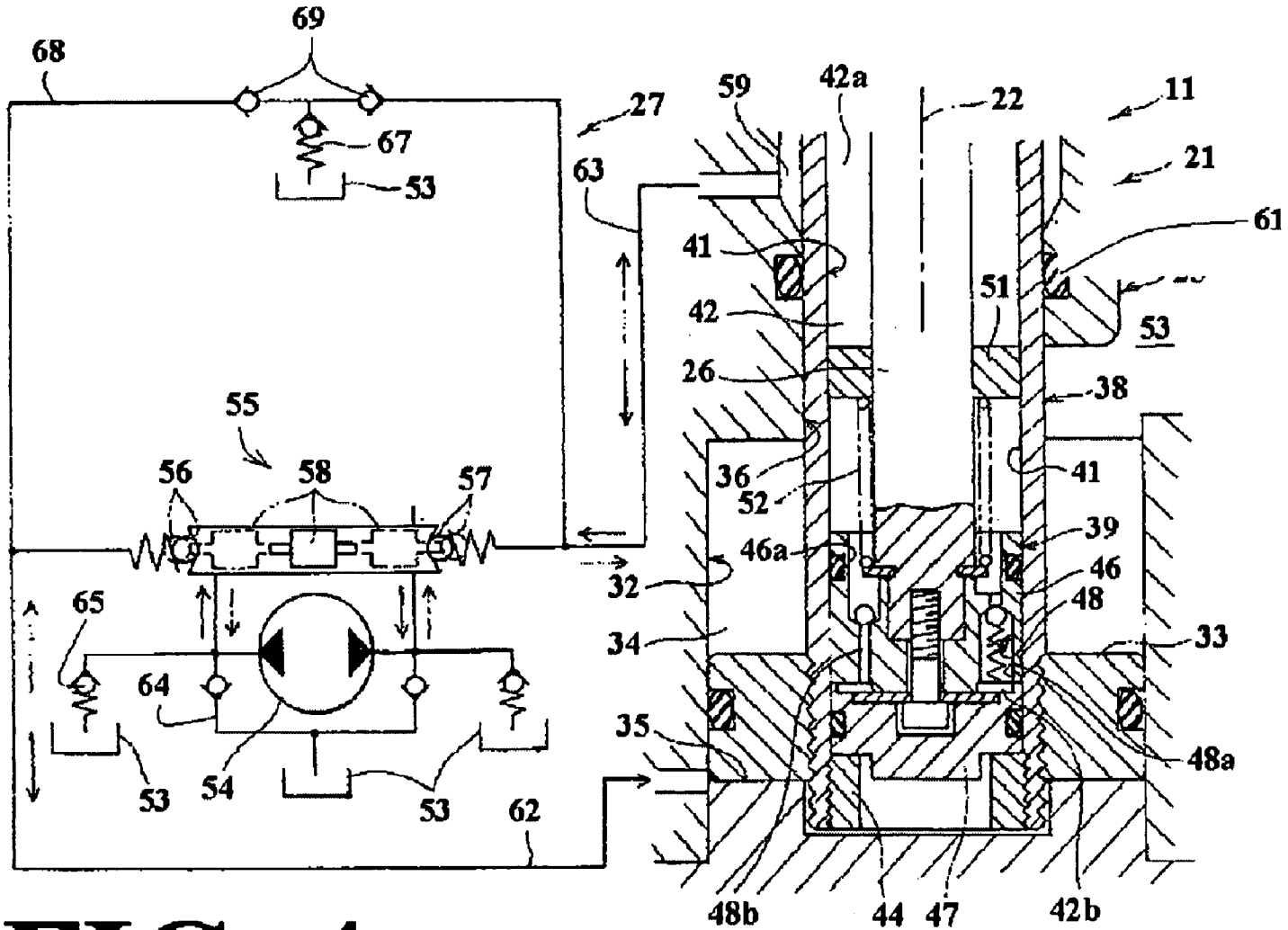
FIG. 4 is a partial cross sectional view in part similar to FIG. 3, but also showing the associated hydraulic circuit, in part schematically.
Figure 8:
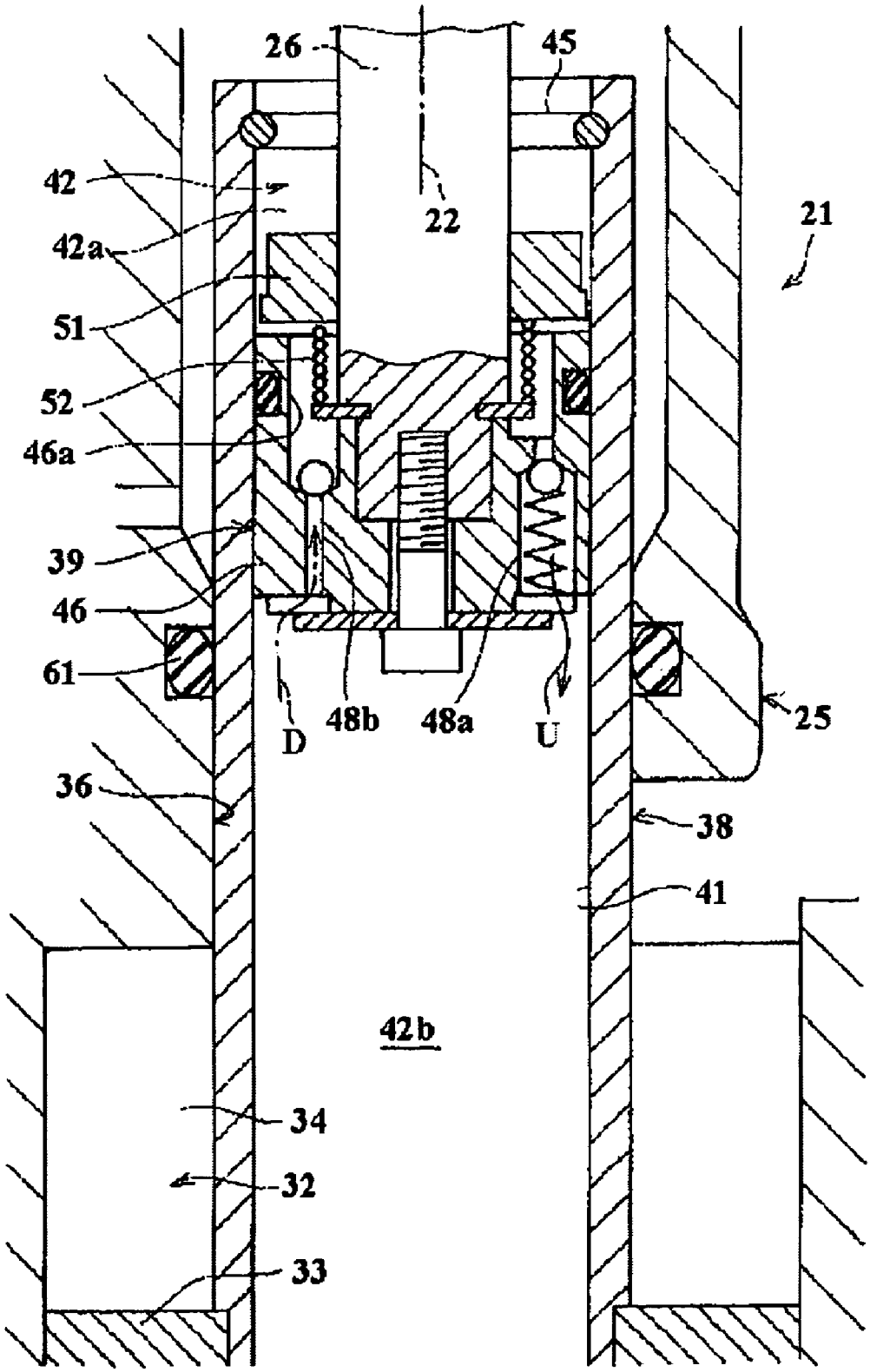
FIG. 8 is an enlarged cross sectional view showing how this embodiment operates to cushion the stopping of extreme pop up.

Referring now additionally to FIGS. 4 and 8, a flow control, damping check valve 48 is disposed in a passage that extends vertically through the upper piston portion 46 for controlling the flow of oil, indicated by the reference numeral 49 between the upper and lower bore areas 42*a* and 42*b* of the upper bore portion 42. The flow control, damping check valve 48 includes a spring-loaded check valve element 48*a* for permitting only an oil 49 flow (shown by the arrow U in FIG. 8) from the upper bore area 42*a* toward the lower bore area 42*b* of the upper bore portion 42 through a small hole for pop up damping purposes when an underwater obstacle is encountered.

An unbiased second, let down check valve 48*b* permits oil 49 to flow as shown by the arrow D in FIG. 8 from the lower bore area 42*b* toward the upper bore area 42*a* through a separate small hole. This permits return from the popped up position when the underwater obstacle is cleared. In addition to permitting popping up of the drive when an underwater obstacle is encountered, the damping check valve resists popping up when operating in reverse.

In order to prevent direct metal to metal contact upon extreme pop up action and to cushion the stopping of such movement, an oil lock piston 51 is fitted into the upper bore area 42*a* of the upper bore portion 42 and normally disposed at a gap above the upper piston portion 46. An annular gap is formed between the inner peripheral surface of the upper bore portion 42 and the outer peripheral surface of the oil lock piston 51 for permitting oil 49 to flow past the oil lock piston 51.

If the oil lock piston 51 is tending to move up further than the upper predetermined position in the upper end in the upper bore portion 42 of the smaller cylinder bore 41, the oil lock piston 51 abuts directly with the stopper ring 45 and thus is prevented from moving up further. Since the oil lock piston 51 is thus prevented from moving up, the upper piston portion 46 is also prevented from moving up further.

A light cushion spring 52 with a low spring constant is interposed between the upper piston portion 46 and the oil lock piston 51 for elastically supporting the oil lock piston 51 above the upper piston portion 46. The cushioning spring 52 is received in recess 46*a* is formed in an upper surface of the upper piston portion 46 of the small piston 39 when the spring 52 is elastically contracted fully in a vertical direction. The receiving recess 46*a* may be formed in either of the upper piston portion 46 or the oil lock piston 51.

Referring now primarily to FIG. 4, the hydraulic control system 27 is contained within the housing 28 which is fixedly attached to the cylinder body 25. It includes a reversible hydraulic pump 54 driven, for example by the aforenoted reversible electric motor contained within the housing 28 for drawing, pressurizing and discharging oil 49 contained in an oil reservoir, shown schematically at 53, formed within the cylinder body 25 and which communicates with the upper chamber 34 of the large diameter cylinder bore 32.

A shuttle valve assembly, indicated generally by the reference numeral 55, is interposed between the pump 54 and the various piston chambers for controlling the tilt and trim movement as will be described. The shuttle valve assembly includes, as is well known in the art, a first check valve 56 for controlling the flow to and from the lower chamber 35 of the large cylinder bore 32 and the smaller cylinder bore 41 provided below the pistons 46 and 47 of the small piston 39. In addition the shuttle valve assembly 55 includes a second check valve 57 for controlling the flow to and from the upper bore portion 42 of the smaller cylinder bore 41. A shuttle piston 58 is also provided to pressure open the first and second check valves 56 and 57, as is well known in the art and in a manner to be described shortly. Specifically, the upper bore area 42*a* communicates with the second check valve 57 through a recess 59 formed in the housing 25 around the cylinder tube 38 formed above the large diameter cylinder bore 32 and sealed therefrom by an O ring 61.

To achieve trim and tilt up operation the reversible motor driving the pump 54 is operated to drive the pump 54 to pressurize the oil 49 for flow in the direction of the solid line arrows in FIGS. 4–7. This pressurizes the left hand side of the shuttle piston 58 causing it to shift to the right as best seen in FIG. 4 to unseat the check valve 57. At the same time the pressure in the shuttle valve 55 opens the check valve 56. Oil under pressure then flows through a conduit shown in part schematically and indicated by the reference numeral 62 to the lower bore portion 35 to drive the large trim piston 33 upwardly in the large diameter cylinder bore 32 to trim up the outboard motor propulsion unit 16 in the direction of the arrow A in FIG. 1.

Figure 5:
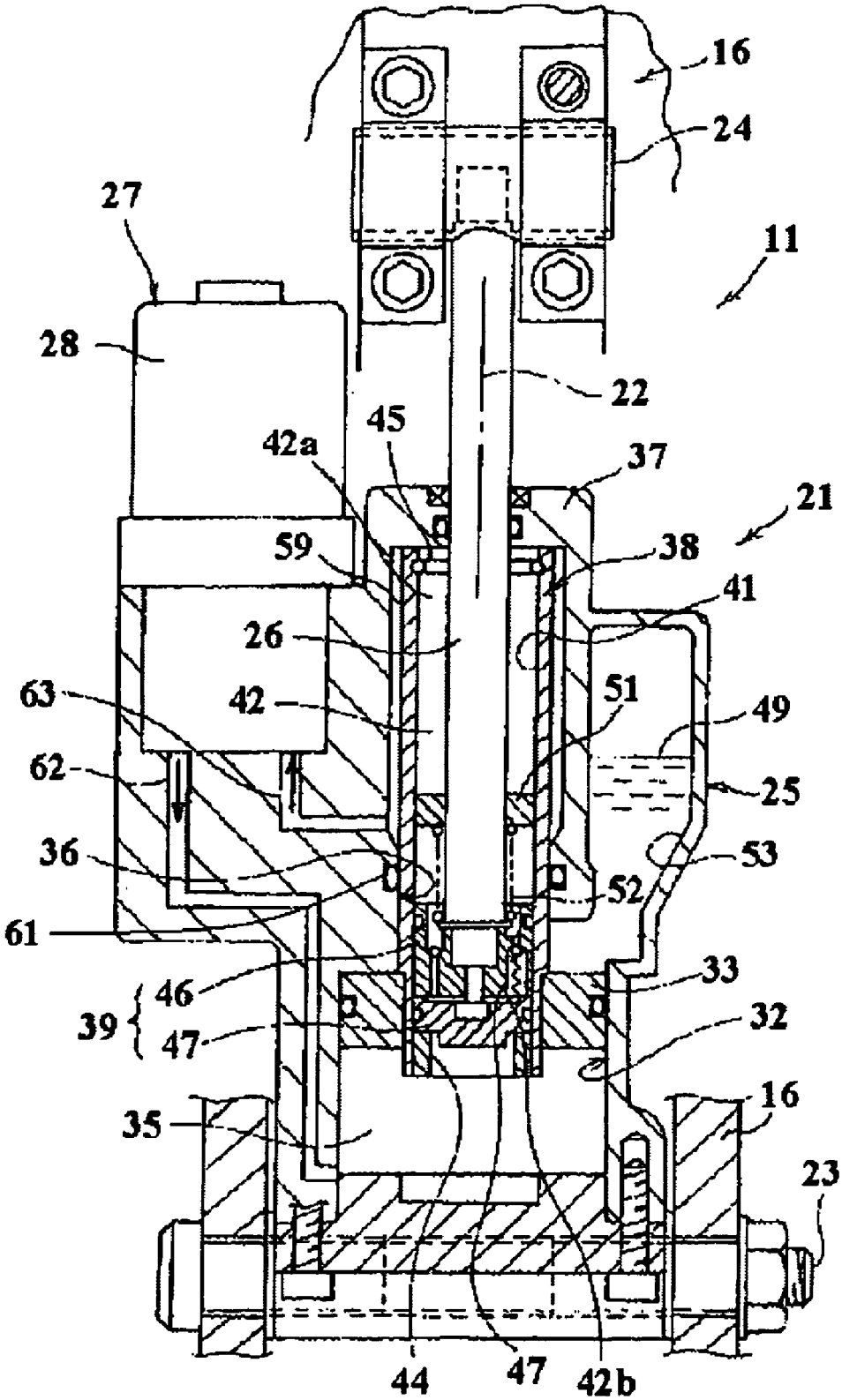
FIG. 5 is a cross sectional view, in part similar to FIG. 3, but showing the fully trimmed up position.

During this trimming up operation, the valves 48*a* and 48*b* will remain closed and the tilt or small piston 39 will move in unison with the large piston 33 until the position shown in FIG. 5 is reached. This upward movement of the pistons 33 and 39 displaces fluid from both the upper chamber 34 directly to the reservoir 53 and from the recess 59 back to the inlet side of the pump 54 through a conduit shown in part schematically at 63 and the check valve 57 which, as previously noted, has been opened by the action of the shuttle piston 58. Because of the area occupied by the cylinder tube 38 and the piston rod 26 less fluid will be displaced than is required for the upward movement and make up fluid can be drawn from the reservoir 53 through a check valved passage indicated in FIG. 4 at 64.

Figure 6:
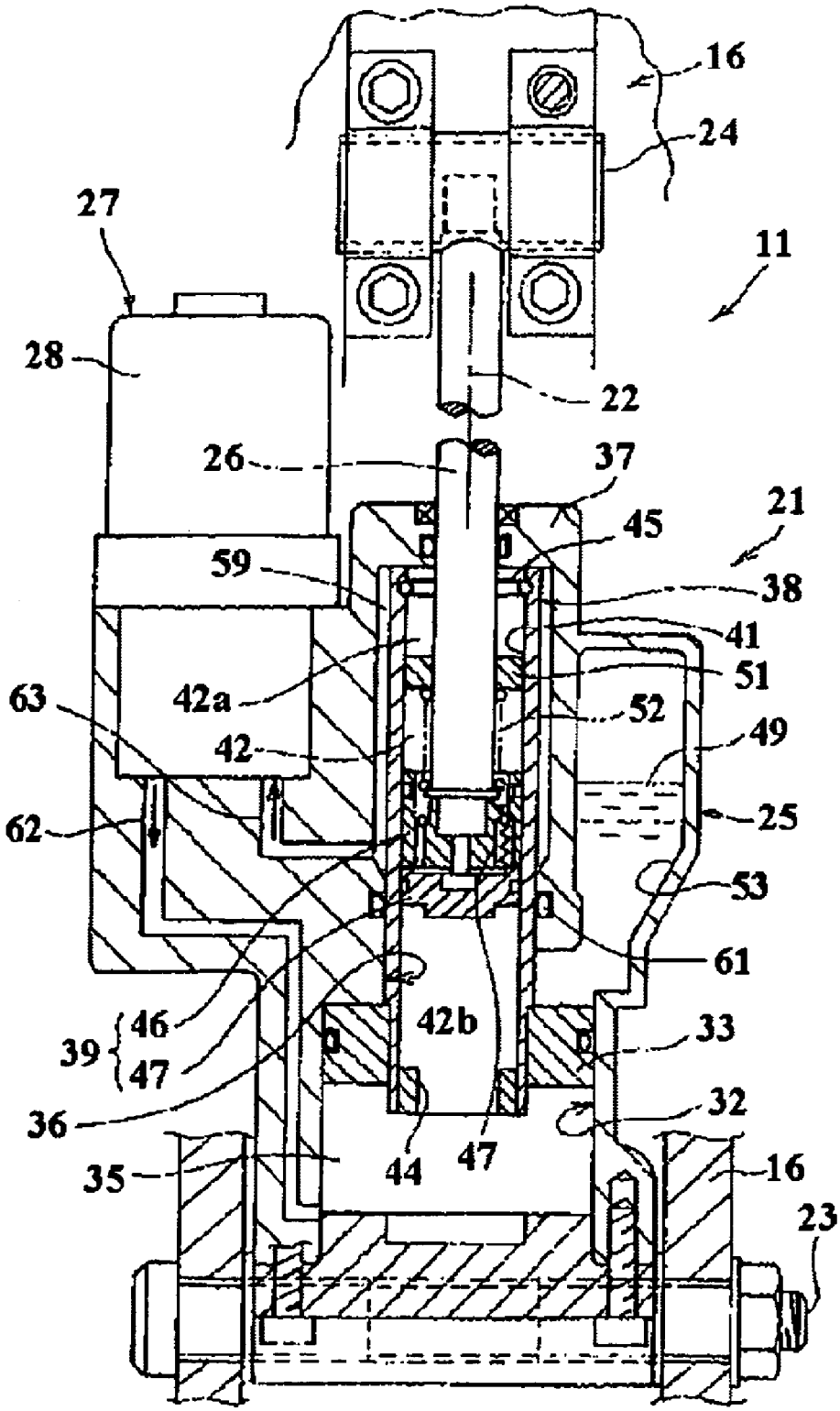
FIG. 6 is a cross sectional view, in part similar to FIGS. 3 and 5, but showing the fully tilted up position

If tilt up operation is required, the motor and pump 54 are operated in the same direction as for trimming up and if the large piston 33 is not in the fully trimmed up position the operation is continued until the fully trimmed up position of FIG. 6 is reached. Then continued operation of the pump 54 is maintained. Since the large piston 33 can no longer move, all of the pumped fluid will be delivered to the lower bore area 42*b* and the piston assembly 39 will continue to move, but at a much faster rate due to its lower effective area, but without as much force as provided by the large piston 33. A positive external stop (not shown) determines this position. Alternatively, contact of the oil lock piston 51 with the upper stopper ring 45 may be employed to set the fully tilted up position. If the operation of the pump 54 is continued after the fully tilted up position is reached, a tilt up relief valve 65 (FIG. 4) will open to bypass the fluid to avoid damage.

Trim and/or tilt down is achieved by operating the pump 54 in the opposite direction and the fluid flow will be in the direction of the broken arrows in FIG. 4. Initially only the small piston assembly 39 and the connected piston rod 26 will move downwardly until the stopper ring 44 is engaged as shown in FIG. 5 and then the trim or large piston 33 will move downwardly with the cylinder tube 38 until the desired trim position is reached. If not stopped earlier a trim down relief valve 66 will open when fully tilted and trimmed down to prevent damage.

Referring now to FIG. 4 it will be seen that a manual valve, indicated by the reference numeral 67, is disposed in a conduit 68 that interconnects the conduits 62 and 63. This valve is disposed between a pair of oppositely operated check valves 69 and when opened permits both conduits 62 and 63 to communicate with the reservoir 53 so that the propulsion unit 16 may be manually moved to a desired tilt or trim position without resistance from the hydraulic system.

Figure 7:
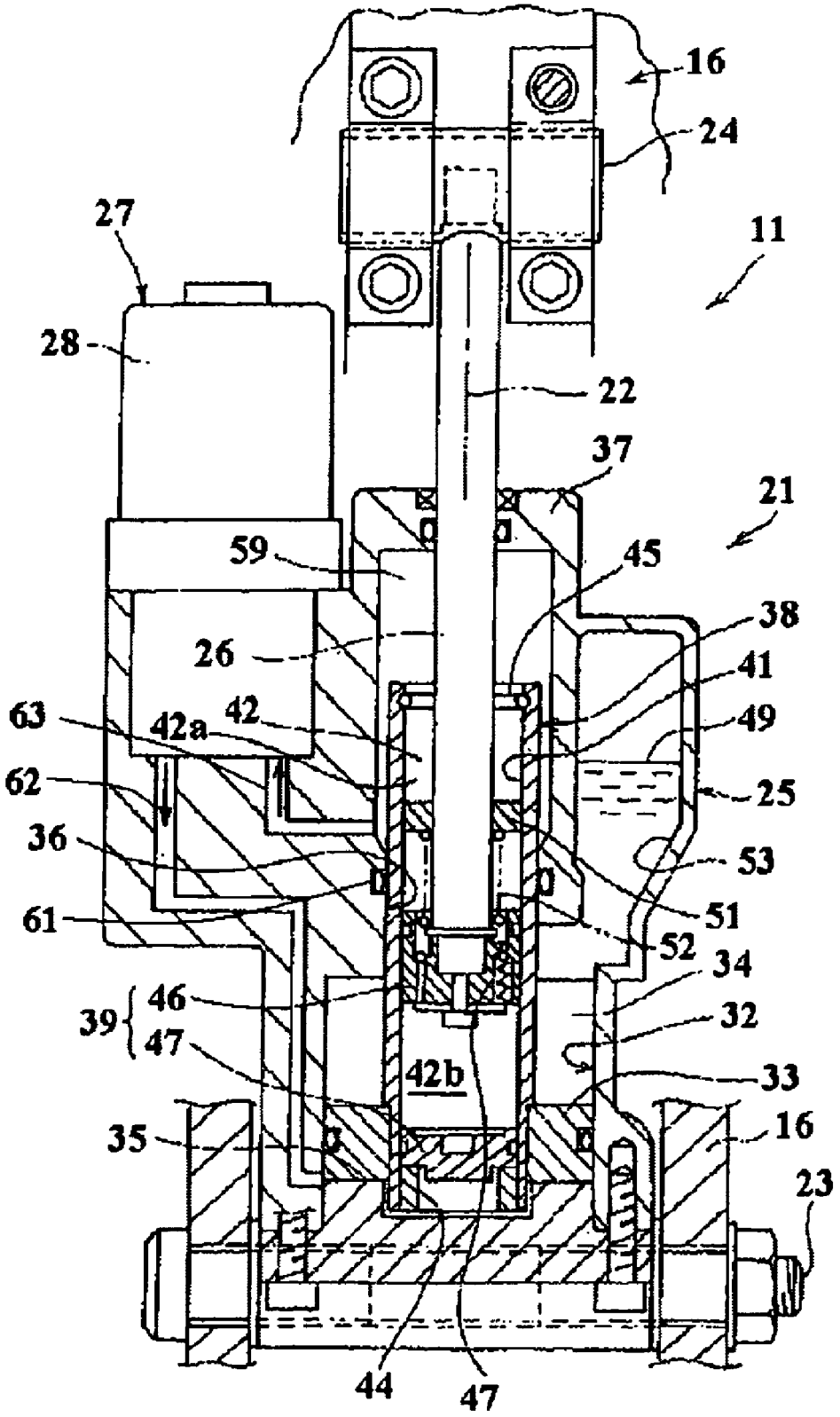
FIG. 7 is a cross sectional view, in part similar to FIGS. 3 but shows the condition when an underwater obstacle is struck.

Referring now to FIGS. 7 and 8, respectively, the way the system operates to permit popping up from any set trim position is permitted when an underwater obstacle is encountered, how the popping up action is damped to a stop and the propulsion unit 16 can return to the trim adjusted position when the obstacle is cleared. These figures depict the fully trimmed down position, but those skilled in the art will readily understand how the device works from any trim adjusted position.

Assuming that an obstruction in the water such as driftwood strikes the lower part of the propulsion unit 16 while the boat 12 is running forward on the water surface under the drive by the propulsion unit 16 of the outboard motor 11, the shock from the obstruction causes the lower part of the propulsion unit 16 to make an aft-and-up swinging movement in the direction of the arrow A in FIG. 1. Then, as seen in FIGS. 7 and 8, the piston rod 26 of the tilt and trim cylinder 21 moves up and the upper piston portion 46 alone, of the upper and lower pistons 46 and 47 of the small piston 39, move up together. At this time, the oil 49 in the upper bore area 42*a* of the upper bore portion 42 of the smaller cylinder bore 41 flows toward the lower bore area 42*b* of the upper bore portion 42 through the first check valve element 48*a* of the flow control, damping check valve 48. The flow control, damping check valve 48 produces damping force by controlling the flow and thus mitigates the shock, thereby preventing the propulsion unit 16 from being damaged by the shock from the obstruction.

At the same time and as best seen in FIG. 8, when the upper piston portion 46 moves up as the shock causes the propulsion unit 16 to make an aft-and-up swinging movement A, the oil 49 in the upper bore area 42*a* of the upper bore portion 42 of the smaller cylinder 41 flows toward the lower bore area 42*b* of the upper bore portion 42 through the flow control, damping check valve 48. Therefore, the position of the oil lock piston 51 in the axial direction of the smaller cylinder 41 does not change significantly. However, the oil lock piston 51, supported by the upper piston portion 46 through the spring 52, gradually moves up as it is pushed by the upper piston portion 46 through the spring 52.

However, the speed of the oil lock piston 51 moving up is lower than the speed of the upper piston portion 46 moving up because of the displacement of the oil above it. Therefore, the upper piston portion 46 approaches the oil lock piston 51 while continuously contracting the spring 52 in the vertical direction, before the oil lock piston 51 reaches the stopper ring 45. At this time, the oil lock piston 51 reduces the opening of the first check valve element 48*a* of the flow control, damping check valve 48 in the upper piston portion 46, which further regulates the oil 49 flow at the flow control, damping check valve 48 to increase the damping force, thereby reducing the shock.

Thus, when the propulsion unit 16 makes a rapid aft-and-up swinging movement A on receiving a shock from an obstruction, the upper piston portion 46 approaches the oil lock piston 51 rapidly, thereby mitigating the shock. Also the upper piston portion 46 is prevented from striking the stopper ring 45 with an impact early after the strike with the obstruction. As a result, the propulsion unit 16 and the tilt and trim cylinder 21 are more effectively prevented from being damaged. Also since the upper piston portion 46 is prevented from striking the stopper ring 45 with a shock early after the strike with the obstruction, the distance between the stopper ring 45 and the upper piston portion 46 can be reduced to permit a reduction in the axial length of the tilt and trim cylinder 21.

As has been previously described, the receiving recess 46*a* formed in at least one of the upper piston portion 46 and the oil lock piston 51 contains the spring 52 entirely when the spring 52 is elastically contracted fully in a vertical direction. Therefore, the upper piston portion 46 further approaches the oil lock piston 51 without being obstructed by the spring 52, and the opening of the first check valve element 48*a* is significantly reduced. As a result, the shock is damped effectively, thereby preventing the propulsion unit 16 and the tilt and trim cylinder 21 from being damaged.

After the underwater obstacle is cleared and the external load on the propulsion unit 16 is released, the upper piston portion 46 moves down as it is pushed down by the self weight of the lower part of the propulsion unit 16 through the piston rod 26. At this time, the oil 49 in the lower bore area 42*b* of the upper bore portion 42 flows into the upper bore area 42*a* through the second check valve 48*b* (as shown by a single-dotted line in FIG. 8), allowing the upper piston portion 46 to move down smoothly. The oil lock piston 51 and the spring 52 move down owing to their own weight to be supported on the upper piston portion 46 to their original state as shown in FIGS. 3 and 4.

Although the stopper ring 44 is shown as being comprised of a separate element, it may be formed integrally with the cylinder tube 38. In addition, the upper chamber 34 of the large cylinder bore 32 may not be used to hold the oil, but may be solely communicated with the atmosphere.

Figure 9:
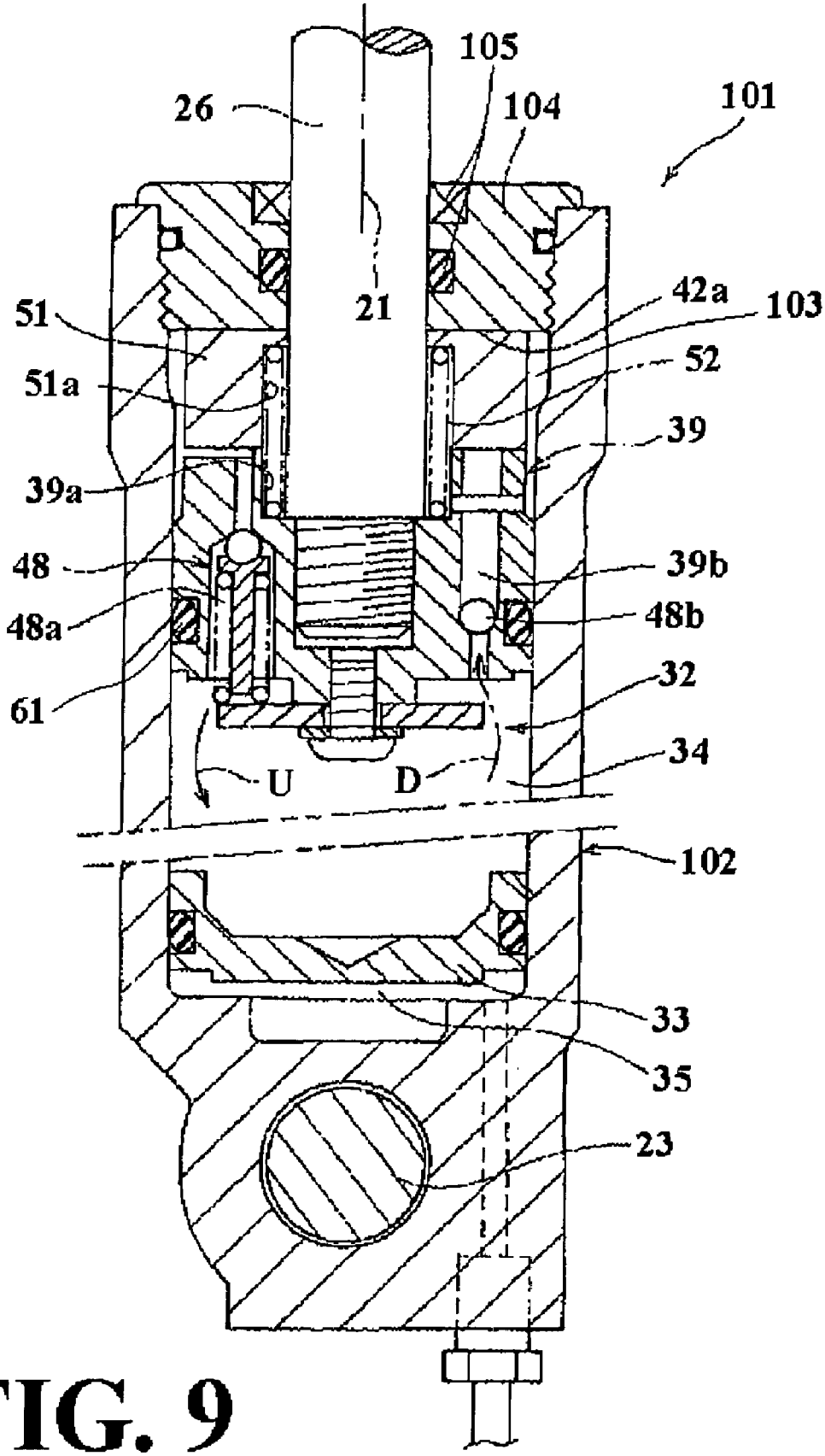
FIG. 9 is a cross sectional view in part similar to FIG. 6, but showing another embodiment of the invention.

Referring now to FIG. 9, this shows another embodiment of the invention, similar to the embodiment of FIGS. 1–8. For this reason components of this embodiment that are the same as or substantially similar to those already described are identified by the same reference numerals and will be described again only insofar as is necessary for those skilled in the art to understand how to practice this embodiment. The tilt and trim cylinder in this embodiment is indicated generally by the reference numeral 101 and includes an outer housing, indicated generally by the reference numeral 102 that forms a single, large cylinder bore 32. The lower end of the outer housing receives the lower pivot 23 for connection to the watercraft hull.

The trim or large piston 33 is supported for reciprocation at the lower portion of the cylinder bore 32 and divides it into a lower chamber 35 and an upper chamber 34. Unlike the previous embodiment the tilt piston 39 is of the same diameter as the trim piston 33 and is directly slidable in the cylinder bore 32 and specifically the upper chamber 34 above the trim piston 33. This forms a damping chamber 103 above the tilt piston 39 in the cylinder bore 32. The upper end of the damping chamber 103 is closed by a removable closure 104 that is threaded into the upper end of the cylinder body 102 and which functions also like the stop ring 45 of the previous embodiment. The piston rod 26 passes through seals 105 contained in the closure 104 for the connection to the propulsion unit (not shown here).

Flow between this damping chamber 103 and the chamber 34 is controlled, like the previously described embodiment by a flow control, damping check valve 48 is disposed in a passage that extends vertically through the tilt piston 39 for controlling the flow of oil, indicated by the arrows between the damping chamber and the upper chamber 34. The flow control, damping check valve 48 includes a spring-loaded check valve element 48*a* for permitting only an oil 49 flow (shown by the arrow U in FIG. 9) from damping chamber 103 toward the upper chamber 34 through a small hole for pop up damping purposes when an underwater obstacle is encountered.

An unbiased second, let down check valve 48*b* permits oil to flow as shown by the arrow D in FIG. 9 from the upper chamber 34 toward the damping chamber 103 through a separate small hole. This permits return from the popped up position when the underwater obstacle is cleared. In addition to permitting popping up of the drive when an underwater obstacle is encountered, the damping check valve 48 resists popping up when operating in reverse.

The oil lock piston 51 is positioned within the damping chamber 103. Receiving recesses 39*a* and 51*a* are formed in an upper surface of the upper piston portion 46 and a lower surface of the oil lock piston 51 for receiving the spring 52 generally entirely when the spring 52 is elastically contracted fully in a vertical direction. In this manner, the total capacity of the receiving recesses 39*a* and 51*a* in the axial direction of the tilt and trim cylinder 101 can be increased sufficiently, and the degree of flexibility in selecting the dimensions and characteristics of the spring 52 can be increased accordingly. The damping arrangement for cushioning the final pop up action is the same as that of the embodiment of FIGS. 1–8 and, therefore, will not be described again.

Thus from the foregoing description it should be readily apparent that the described embodiments provide a very compact tilt and trim arrangement wherein the popping up action is effectively damped without positive stops that could cause abrupt stopping and possible damage. Of course those skilled in the art will readily understand that the described embodiments are only exemplary of forms that the invention may take and that various changes and modifications may be made without departing from the spirit and scope of the invention, as defined by the appended claims.

What is claimed is:

1. A tilt and trim arrangement for an outboard drive supported for pivotal movement about an axis on a watercraft hull, said arrangement comprising a first unit fixed for pivotal movement relative to the hull and a second unit adapted to be connected to the outboard drive, one of said units comprising a body defining a cylinder bore, the other of said units comprising a piston reciprocating in said cylinder bore and dividing said cylinder bore into two axially spaced chambers and a piston rod fixed to said piston and extending through one of said chambers for connection to the respective of the outboard drive and the hull, shock absorbing valves for controlling a flow between said cylinder chambers upon movement of said piston relative to said cylinder bore, and a spring biased piston contained in one of said chambers for further damping the degree of movement of said piston in said one chamber.

2. A tilt and trim arrangement for an outboard drive as set forth in claim 1 wherein the piston is positioned in a chamber above a trim piston supported for reciprocation through a trim range of lesser stroke than that of said piston and said piston comprises a tilt up piston for tilting the outboard drive to an above the water position.

3. A tilt and trim arrangement for an outboard drive as set forth in claim 1 wherein the spring biasing the spring biased piston comprises a coil spring encircling the piston rod.

4. A tilt and trim arrangement for an outboard drive as set forth in claim 3 wherein the spring is contained at least in part in a recess formed in at least one of the spring biased piston and the first mentioned piston.

5. A tilt and trim arrangement for an outboard drive as set forth in claim 4 wherein the spring containing recess is formed in both the spring biased piston and the first mentioned piston.

6. A tilt and trim arrangement for an outboard drive as set forth in claim 5 wherein the piston is positioned in a chamber above a trim piston supported for reciprocation through a trim range of lesser stroke than that of said piston and said piston comprises a tilt up piston for tilting the outboard drive to an above the water position.

* * * * *